US008132697B2

(12) United States Patent
Finlay et al.

(10) Patent No.: US 8,132,697 B2
(45) Date of Patent: Mar. 13, 2012

(54) DISPENSING MECHANISM USING LONG TUBES TO VARY PRESSURE DROP

(75) Inventors: Patrick J. Finlay, Fairfield, CT (US); James M. Collins, Arlington, PA (US); Andrzej Skoskiewicz, Menlo Park, CA (US); Kenneth Ritsher, Chicago, IL (US)

(73) Assignee: PepsiCo, Inc., Purchase, NY (US)

( * ) Notice: Subject to any disclaimer, the term of this patent is extended or adjusted under 35 U.S.C. 154(b) by 0 days.

(21) Appl. No.: 13/049,598

(22) Filed: Mar. 16, 2011

(65) Prior Publication Data

US 2011/0168736 A1 Jul. 14, 2011

Related U.S. Application Data

(62) Division of application No. 12/636,499, filed on Dec. 11, 2009, now Pat. No. 7,931,174, which is a division of application No. 11/081,109, filed on Mar. 16, 2005, now Pat. No. 7,641,080.

(60) Provisional application No. 60/553,538, filed on Mar. 17, 2004.

(51) Int. Cl.
*B67D 7/78* (2010.01)

(52) U.S. Cl. ... 222/464.1; 222/1; 222/142.6; 222/144.5; 222/145.1; 222/394; 222/509

(58) Field of Classification Search ..... 222/464.1, 222/1, 506, 509, 501, 518, 144.5, 129.1, 222/559, 514, 516, 400.7, 142.7, 394, 142.6, 222/142.9, 145.1, 144, 527–529, 396, 464.3, 222/402.13; 251/320, 337, 339, 402.1
See application file for complete search history.

(56) References Cited

U.S. PATENT DOCUMENTS

| | | | | | |
|---|---|---|---|---|---|
| 2,682,977 | A | | 7/1954 | Spiess | |
| 2,778,543 | A | | 1/1957 | Urlaub | |
| 2,815,889 | A | | 12/1957 | Stetz | |
| 2,879,801 | A | * | 3/1959 | Cornelius | 137/636.2 |
| 3,377,004 | A | | 4/1968 | Kjelson | |
| 3,998,364 | A | * | 12/1976 | Hollander | 222/511 |
| 4,142,652 | A | | 3/1979 | Platt | |
| 4,154,378 | A | | 5/1979 | Paoletti | |
| 4,433,797 | A | | 2/1984 | Galia | |
| 5,110,014 | A | * | 5/1992 | Doundoulakis | 222/396 |
| 5,341,968 | A | * | 8/1994 | Vandoninck | 222/396 |
| 5,390,832 | A | * | 2/1995 | Lombardo | 222/394 |
| 5,443,186 | A | * | 8/1995 | Grill | 222/396 |
| 5,501,375 | A | * | 3/1996 | Nilson | 222/402.13 |
| 5,520,310 | A | * | 5/1996 | Bauer et al. | 222/402.2 |
| 6,036,054 | A | * | 3/2000 | Grill | 222/3 |
| 6,145,712 | A | * | 11/2000 | Benoist | 222/402.1 |
| 6,299,027 | B1 | | 10/2001 | Berge et al. | |
| 6,491,189 | B2 | | 12/2002 | Friedman | |
| 6,550,640 | B2 | * | 4/2003 | Smith | 222/1 |
| 6,742,680 | B2 | * | 6/2004 | Friedman | 222/509 |
| 7,040,514 | B2 | * | 5/2006 | Colan et al. | 222/402.13 |
| 7,631,786 | B2 | * | 12/2009 | Finlay et al. | 222/189.1 |
| 7,641,080 | B2 | * | 1/2010 | Finlay et al. | 222/464.1 |
| 7,931,174 | B2 | * | 4/2011 | Finlay et al. | 222/394 |

* cited by examiner

*Primary Examiner* — Frederick C. Nicolas
(74) *Attorney, Agent, or Firm* — Banner & Witcoff, Ltd.

(57) ABSTRACT

A fountain-style carbonated soft drink dispenser includes a housing adapted to attach to a beverage container, an actuator for selectively opening a fluid conduit, and one or more long tubes that vary a pressure drop across the dispensing assembly and convey fluid. The resistance through the tube(s) is decreased as the pressure within the container decreases so as to maintain a substantially constant flow rate throughout dispensing.

19 Claims, 10 Drawing Sheets

DISPENSING MECHANISM USING LONG TUBES TO VARY PRESSURE DROP

This application claims the benefit of, and is a divisional of, prior U.S. patent application Ser. No. 12/636,499, filed Dec. 11, 2009, which is a divisional of U.S. patent application Ser. No. 11/081,109 filed Mar. 16, 2005, now U.S. Pat. No. 7,641,080, issued Jan. 5, 2010, which claims the benefit of U.S. Provisional Application No. 60/553,538 filed Mar. 17, 2004, which applications are incorporated in their entirety into the present application by reference.

FIELD OF THE INVENTION

The present invention relates to a dispensing mechanism that can be used with a container for a carbonated beverage, for example, and that provides a variable pressure drop in order to compensate for a change in pressure in the bottle.

Post-mix fountains for dispensing carbonated beverages, such as sodas, have been used for years in various venues, such as convenience stores and restaurants. Post-mix fountains combine the ingredients of the carbonated beverage (e.g., syrup or concentrate and carbonated water) immediately prior to the beverage begin dispensed into a glass. Such fountains are convenient and economical because they allow the convenience store or restaurant owner to purchase large quantities of syrup or concentrate and carbon dioxide used to make the beverage at bulk prices. Furthermore, less waste is produced and less space is used by packaging, since the ingredients of the fountain beverage come in large containers, rather than smaller containers sold to consumers, such as, for example, twelve ounce beverage cans or two liter bottles. In addition, the fountain is convenient for uses to operate, because there is no need to open bottles or cans to fill a glass with beverage. One of the benefits of post-mix fountains is their ability to dispense each poured serving of beverage at a uniform carbonation level, typically using the carbonation level of a bottled or canned beverage as a reference.

These fountains typically require a separate canister of gas, such as carbon dioxide gas, to carbonate water that is mixed with the syrup to form the beverage, and to propel or pump the syrup from its container. Although this arrangement is appropriate for large-scale users such as convenience stores and restaurants, it is less advantageous for smaller-scale users, such as home users. However, home users can still realize many of the benefits of fountains, particularly the lower cost, reduced waste, and ease of use that such fountains offer.

Seltzer bottle for dispensing seltzer water from a bottle are also known in the art. These seltzer bottles typically use the carbonation of the seltzer water itself to propel it from the bottle, and do not require an additional container of the seltzer water itself to propel it from the bottle, and do not require an additional container of carbon dioxide. However, there are several drawbacks associated with this type of seltzer dispenser. For instance, such seltzer bottles are difficult to control and often are discharged with substantial force, causing the seltzer water to spray out of control. When seltzer water is dispensed in this manner foaming may occur, which causes the dispensed seltzer water to lose some of its carbonation and become "flat". Another drawback with this type of seltzer bottle is that the pressure in the seltzer bottle is often depleted before all the contents of the container have been dispensed. Thus, a residual amount of unused material remains in the bottle and cannot be dispensed because there is insufficient pressure remaining to propel the residual material from the container.

The present inventors found that the pressure within such conventional seltzer bottles fluctuates as the beverage is depleted. That is when the seltzer bottle is full, the pressure within the bottle is at a maximum. As the seltzer bottle becomes depleted, the pressure within the bottle becomes correspondingly depleted. Since the pressure within the seltzer bottle decreases during its use, it follows that the pressure available to propel the beverage out of the bottle decreases as well. Therefore, the beverage may be propelled out of the bottle too quickly when the bottle is full and/or too slowly when the bottle is less than full.

Conventional cans of carbonated beverages are relatively inexpensive, but have the disadvantage that once they are opened, they cannot be resealed. Once opened, the carbon dioxide or other gas dissolved in the beverage gradually comes out of solution or "leaks."Thus, if not consumed shortly after being opened cans of carbonated beverage will become flat. Accordingly, cans are not suitable for storing multiple servings of carbonated: beverages.

Bottles are superior to cans in that they are able to be resealed after being opened, but when opened, the carbonation still escapes from the bottle. Thus, after a bottle has been opened several times, the beverage will begin to become flat. For this reason, even bottles are not well suited for containing multiple servings of carbonated beverages.

There is, therefore, a need in the art for a beverage dispenser that is inexpensive, easy for a home user to operate, and that eliminates the problems associated with the prior art dispensers, cans, and bottles. The present invention is directed to remedying these and other deficiencies of the prior art dispensing devices.

SUMMARY OF THE INVENTION

According to one aspect, the present invention relates to a dispensing assembly including a housing adapted to attach to a container, an actuator for selectively opening a fluid outlet of the housing, the actuator connected to the housing, at least one tube communicating with the fluid outlet and causing resistance of fluid flow from the container to the fluid outlet and varying means of varying the resistance caused by the at least one tube.

According to another aspect, the present invention relates to a method of dispensing fluid including providing at least one tube through which fluid flows from a container, the at least one tube communicating with a fluid outlet and causing resistance of fluid flow from the container to the fluid outlet, selectively opening the fluid outlet and varying the resistance caused by the at least one tube.

These and other features and advantages of the present invention will become apparent from the description of the preferred embodiments, with reference to the accompanying drawing figures.

DETAILED DESCRIPTION OF THE PREFERRED EMBODIMENTS

Figure 1:
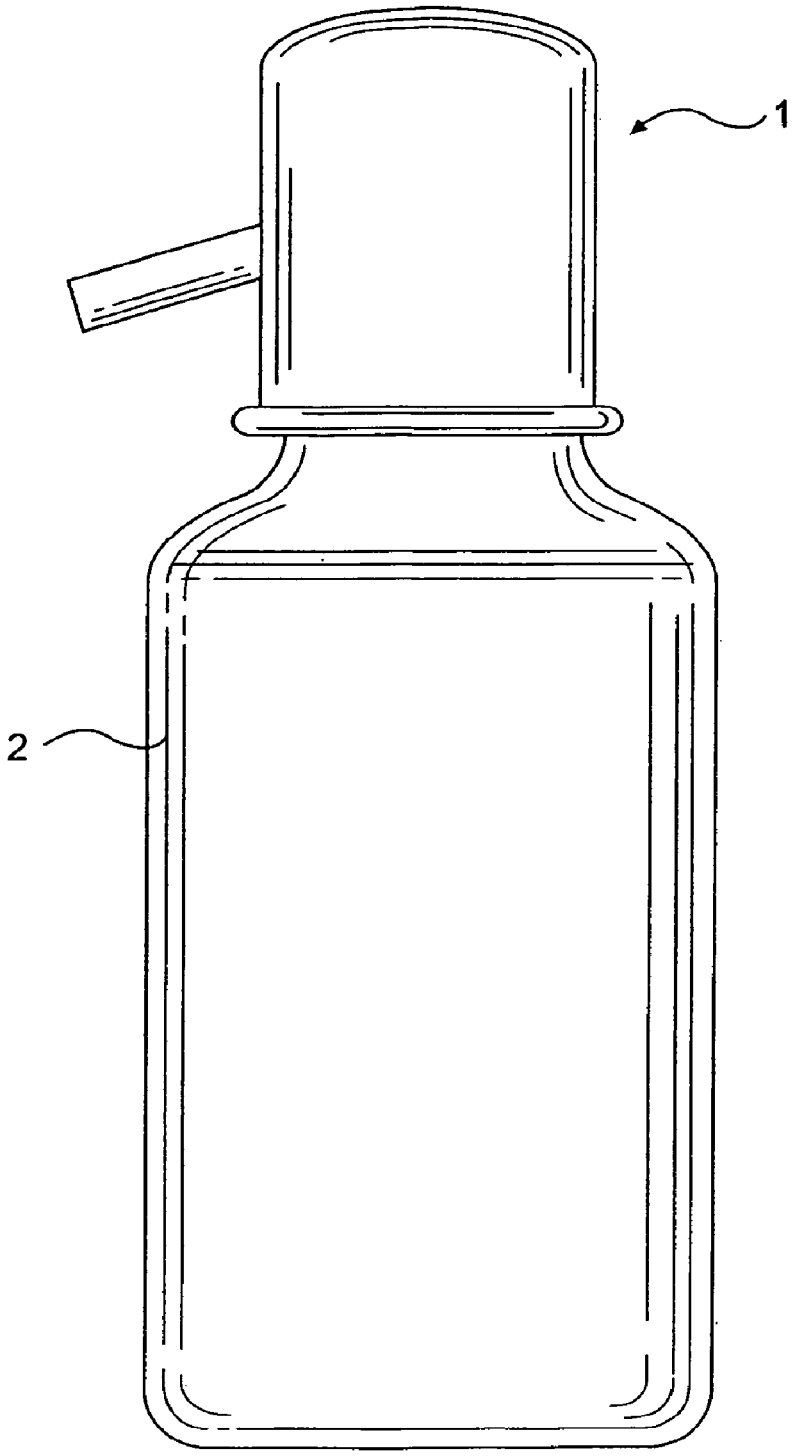
FIG. 1 is a side view showing of a dispensing mechanism of the present invention attached to a bottle or container.

The present invention relates to an easy-to-use, fountain-style beverage (such as a soda or soft-drink) dispenser. The fountain-style dispenser provides the benefits of a fountain dispenser commonly seen in convenience stores and restaurants, including reduced waste and the beneficial economics of bulk purchasing, yet does not require an additional, cumbersome tank of $CO_2$ or syrup supply. Rather, a dispensing mechanism 1 is attached directly to a container 2, such as a bottle, as shown in FIG. 1. The dispensing mechanism 1 uses the pressure from the carbonation in the soda or soft drink (hereinafter "beverage") —the effects of which are commonly experienced by the firmness of an unopened beverage bottle or can and the hissing sound it generates when first opened—to propel the beverage out of the container.

The present inventors understood that the pressure within the container 2 fluctuates as the beverage is consumed. When the container 2 is fill, the pressure within the bottle is at a maximum. When the container 2 is substantially less than full, the pressure within the container 2 is substantially less (keeping other factors such as temperature constant). Since the pressure within the container 2 decreases, it follows that the pressure available to propel the beverage out of the container 2 decreases as well. Therefore, the beverage may be propelled out of the container 2 too quickly when the container 2 is full and too slowly when the container 2 is less than full unless a mechanism for varying the pressure drop is provided.

The following embodiments are directed to using the beverage itself to propel the beverage out of the container 2 despite variable pressures within the bottle by providing a dispensing mechanism 1 that is capable of varying the pressure drop (that is, increasing or decreasing the flow resistance) across the dispensing mechanism 1. In this way, when the container 2 is full and the pressure therein is greatest, the pressure drop across the dispensing mechanism 1 can be greatest, and as the beverage in the container 2 is consumed, the pressure drop across the dispensing mechanism 1 can be decreased. At any rate, the pressure drop for any given pressure within the container is preferably large enough so that high pressure within the container 2 is reduced at the exit of the dispensing mechanism 1 to propel the beverage out of the container 2 at a sufficient rate to fill a glass in a reasonable amount of time with a smooth flow.

First Embodiment

Figure 2:
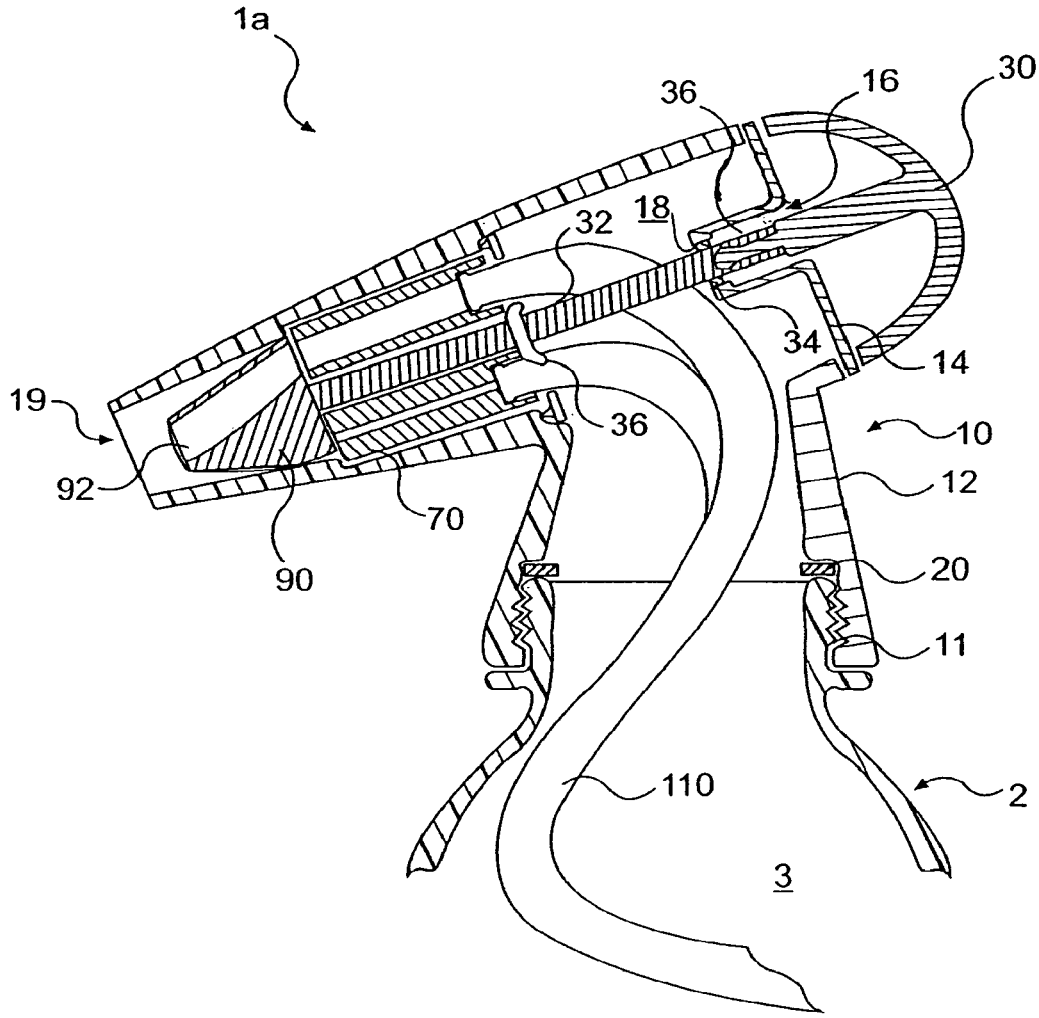
FIG. 2 is a partial cross-sectional view of a dispensing mechanism according to a first embodiment of the present invention.

FIG. 2 shows a cross-section of the dispensing mechanism 1*a* according to the first embodiment. The dispensing mechanism 1*a* generally comprises a handle 30, a housing 10, a resistance selector 70 and a flow cone 90. The dispensing mechanism 1*a* of the first embodiment is operated by a turn of the handle 30, whereby a user can adjust the pressure drop across the dispensing mechanism 1*a*, as will be described in greater detail below.

As shown in FIG. 2, the housing 10 attaches to the container 2 by way of threads 11, although other ways of attaching the housing 10 are contemplated, such as a bayonet coupling, or a snap-on fastener, or integral molding. Preferably, a seal 20 is provided between the housing 10 and the container 2, although such seal 20 may be omitted.

Figure 3:
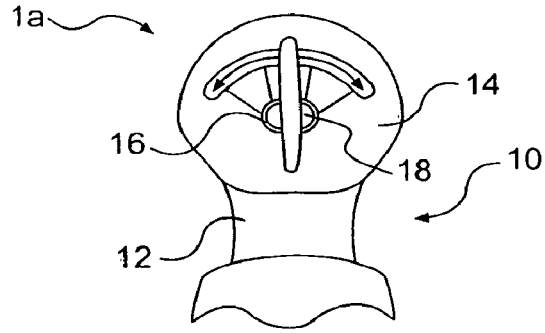
FIG. 3 is a partial, rear view of the dispensing mechanism according to the first embodiment.

The housing 10 preferably comprises a main body 12 and an end cap 14, which may be welded, threaded, glued, or otherwise attached to the body 12. The end cap 14 may have a dial printed on or affixed to the end cap 14 as shown in FIG. 3 and discussed in more detail below. The end cap 14 includes a recess 16 through which an aperture 18 is provided. As shown in FIG. 2, as shaft 32 extends through the aperture 18 within the recess 16 in the end cap 14, through the resistance selector 70, to the flow cone 90.

Preferably, a seal 34 between the end cap 14 and shaft 32 and a seal 36 between the resistance selector 70 and the shaft 32 are provided to prevent gas or liquid from exiting the housing 10, although the seals 34, 36 may be omitted in favor of some other means for blocking gas or liquid, such as close to tolerance between the shaft 32 and the end cap 14 and resistance selector 70. The seals 34, 36 or close tolerances permit the shaft 32 to rotate when the handle 30 is rotated.

One end of the shaft 32 is affixed to the handle 30 by a snap-on fit, welding gluing or other means for joining known in the art, provided that the shaft 32 rotates when the handle 30 is rotated. On its other end, the shaft 32 extends through the resistance selector 70 and is affixed to or integrally formed with the flow cone 90, so that a rotational force exerted on the handle 30 transfers through the shaft 32 to the flow cone 90. In this way, when the handle 30 is rotated, the flow cone 90, but not the resistance selector 70, rotates. Of course, the opposite arrangement may be employed where the flow cone is stationary and the resistance selector is rotated by the shaft.

The flow cone 90 has a generally frusto-conical shape, whereby an end that is disposed near the resistance selector 70 has a greater diameter than an end near an exit aperture 19 of the housing 10. Of course, other shapes may be provided. The flow cone 90 includes a chamber or passage 92 through the length of the flow cone 90 to permit fluid flow therethrough.

Figure 4:
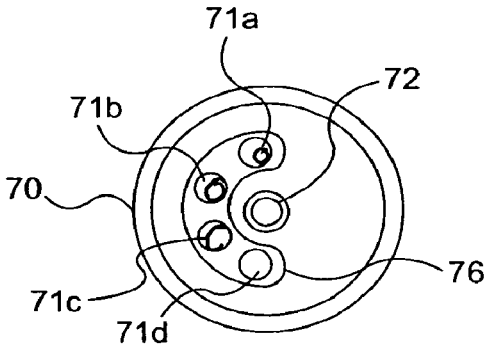
FIGS. 4 and 5 are side views of a resistance selector according to the first embodiment.

As shown in FIG. 4, the resistance selector 70 comprises a shaft aperture 72, through which the shaft 32 extends, a plurality of flow paths 71*a*, 71*b*, 71*c*, 71*d*, and a recessed portion 76 in which openings of the flow paths 71*a*-71*d* are disposed. Four flow paths are shown, but any number may be provided. Each of the flow paths 71*a*-71*d* preferably has an inner diameter different from every other flow path, and the lengths of all of the flow paths 71*a*-71*d* are preferably the same. Preferably, the flow paths 71*a*-71*d* are sequentially arranged with increasing inner diameters so that, if the flow paths 71*a*-71*d* have circular cross sections, the openings of the smallest- and largest-diameter flow paths are at opposite ends of the recessed portion 76. In this way, if the diameter of flow path 71*a* is the smallest, flow path 71*b* is larger, and so on. The different diameters result in different pressure drops across the resistance selector 70, in accordance with the well-known principle that a small-diameter pipe will have a larger pressure drop across it than a large-diameter pipe of the same length.

Figure 5:
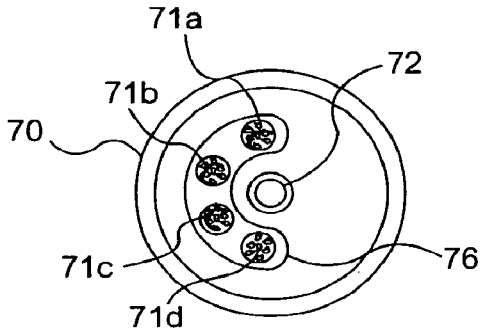

Each of the flow paths 71*a*-71*d* of the resistance selector 70 may comprise a single aperture, as shown in FIG. 4, or a bunched plurality of apertures, as shown in FIG. 5. If plural bunched apertures are used, each individual aperture may be of the same size, but the number of apertures varies per flow path to vary the resistance among the flow paths. Alternatively, the size and/or number of apertures could vary per flow path. Also, all of the flow paths 71*a*-71*d* may be a single aperture, all may be a bunched plurality of apertures, or some flow paths may be a bunched plurality of apertures while others are single apertures.

As shown in FIG. 2, the resistance selector 70 sealingly contacts tubes 110 at one end and the flow cone 90 at the other ends so that the fluid and gas will not escape. The resistance selector 70 sealingly contacts the flow cone 90, for example, by simply bringing the resistance selector 70 and the flow cone 90 into firm abutment. Alternatively, a seal may be provided between the flow cone 90 and the resistance selector 70. In any event, any friction between the flow cone 90 and resistance selector 70 is low enough that the flow cone 90 is able to rotate with respect to the resistance selector 70.

The resistance selector 70 sealingly contacts the tubes 110, for example, by firmly holding ends of the tubes 110 in the recessed portion 76. This may be accomplished by sizing the recessed portion 76 so that the ends of the tubes 110 friction-fit within the recessed portion 76. Other means may be used to sealingly connect the resistance selector 70 to the tubes 110, such as a clamp, clip, glue, or welding. In any event, gas and liquid are preferably prevented from exiting at the junction between the tubes 110 and the resistance selector 70.

Figure 6:
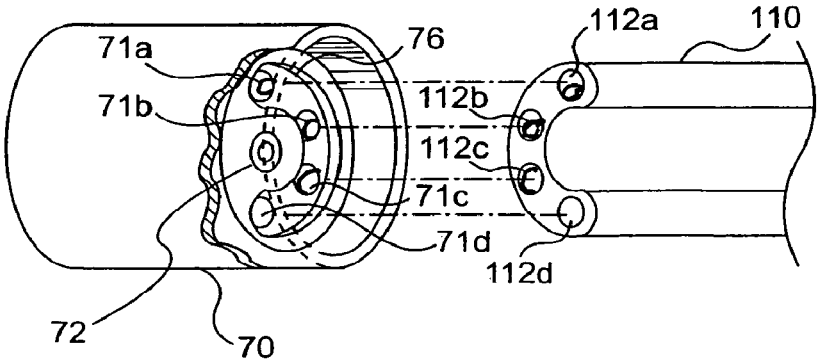
FIG. 6 is an exploded view of the resistance selector and tubes according to the first embodiment.

As shown in FIG. 6, the tubes 110 preferably form an integrated member having an elongated, slightly curved cross-section. The tube member 110 may be sectioned, forming a plurality of tubular sections 112*a*, 112*b*, 112*c*, 112*d*, one corresponding to each flow path 71*a*, 71*b*, 71*c*, 71*d*, as shown in FIG. 6. Each tubular section is preferably of a different internal diameter, and preferably of the same internal diameter as its corresponding flow path in the resistance selector 70. This will minimize any non-smooth transition points in fluid flow to minimize foaming. Alternatively, if resistance selector 70 is to be used as the sole mechanism to vary resistance, a single tube can be used and connected to the openings of the flow paths 71*a*-71*d* by a plenum-type connection or any other suitable connection.

When the dispensing mechanism 1*a* is assembled as shown in FIG. 2, a continuous conduit can be formed so that gas and liquid can flow from the interior 3 of the container 2, into the tubes 110, through the resistance selector 70 and the flow cone 90, and out of exit aperture 19 to the exterior of the dispensing mechanism 1*a*. As previously stated, the junctions between each of the tubes 110, resistance selector 70 and flow cone 90 preferably are such that gas and liquid will not leak therefrom and are smooth to minimize foaming at the junctions.

In a preferred method of operation, the chamber 92 in the flow cone 90 is initially out of alignment with the flow paths 71*a*-71*d*, preventing gas or liquid flow. Preferably, in this configuration, the handle 30 is positioned over a part of the dial printed on the end cap 14 that is marked "OFF," "CLOSED" or some other similar designation, whether in words or graphic depictions. To start the beverage flowing out of the container 2, a user rotates the handle 30, which in turn rotates the shaft 32 and the flow cone 90, until the handle 30 aligns with a marking on the end cap 14, such as that shown in FIG. 3. When the handle 30 is so aligned, the chamber 92 in the flow cone 90 aligns with one of the flow paths 71*a*-71*d* and as a result, fluid flows from the interior 3 of the container 2, through one of the tubes 110, resistance selector 70 and flow cone 90, out of the exit aperture 19.

When a carbonated beverage is dispensed, the pressure in the container due to the carbonation is used to propel the fluid beverage. By using a long tube 110 and corresponding flow path 71*a*-71*d*, the local gas pressure in the liquid is gradually reduced as the liquid flows through the tube, thereby keeping the gas in solution in the liquid during dispensing. The exit velocity of the beverage is also reduced to a manageable level, so the beverage can be dispensed into another container without undue agitation, exolution of gas or foaming. That is, the dispenser can control both the rate of dispensing and level of foaming.

As previously discussed, each flow path 71*a*-71*d* is of a different diameter than adjacent flow paths, so that each flow path causes a different pressure drop. Preferably, as a user rotates the handle 30 to start fluid flow, the first flow path 71*a* causes the greatest pressure drop. If a user determines that the resulting pressure drop is too great, the user preferably continues to rotate the handle 30 to select an incrementally larger-diameter flow path 71*b*, which has a lower pressure drop. The user can continue to turn the handle 30 in this way until the largest-diameter flow path 71*d* or an acceptable flow path is selected. In a new container in which the carbonation level is high, a smaller-diameter tube is selected. As the volume of the container is depleted and the internal pressure due to carbonation decreases (or if the container is relatively full, but the carbonation level is low), the same flow rate can be maintained throughout dispensing of the entire container by selecting increasingly larger flow paths.

It should be noted that fluid flow need not be limited to just a single tube and flow path during dispensing. Flow cone 90 and resistance selector 70 can be designed such that more than one flow path 71*a*-71*d* can communicate with chamber 92 at the same time. The range of resistance variation can be increased by selecting one or more appropriate flow paths. In this regard, if one or more flow paths and tubes can be selected at a time, the tubes and flow paths can be of uniform diameters. Resistance to flow will be highest when only one flow path is selected and will correspondingly decrease with each additional selected flow path.

It should also be noted that the resistance of the flow paths and the tubes need not be differentiated solely by differing the internal diameters. Resistances can also be differentiated by varying the effective length of the tubes 110 and/or flow paths 71*a*-71*d* or by using different materials. Any combination of the foregoing can also be used.

Second Embodiment

The second embodiment operates on similar principles to the first embodiment; to wit, a pressure drop is varied across a dispensing mechanism 1*b* in accordance with the pressure within the bottle 2. In the second embodiment, the pressure drop is adjusted automatically.

Figure 7:
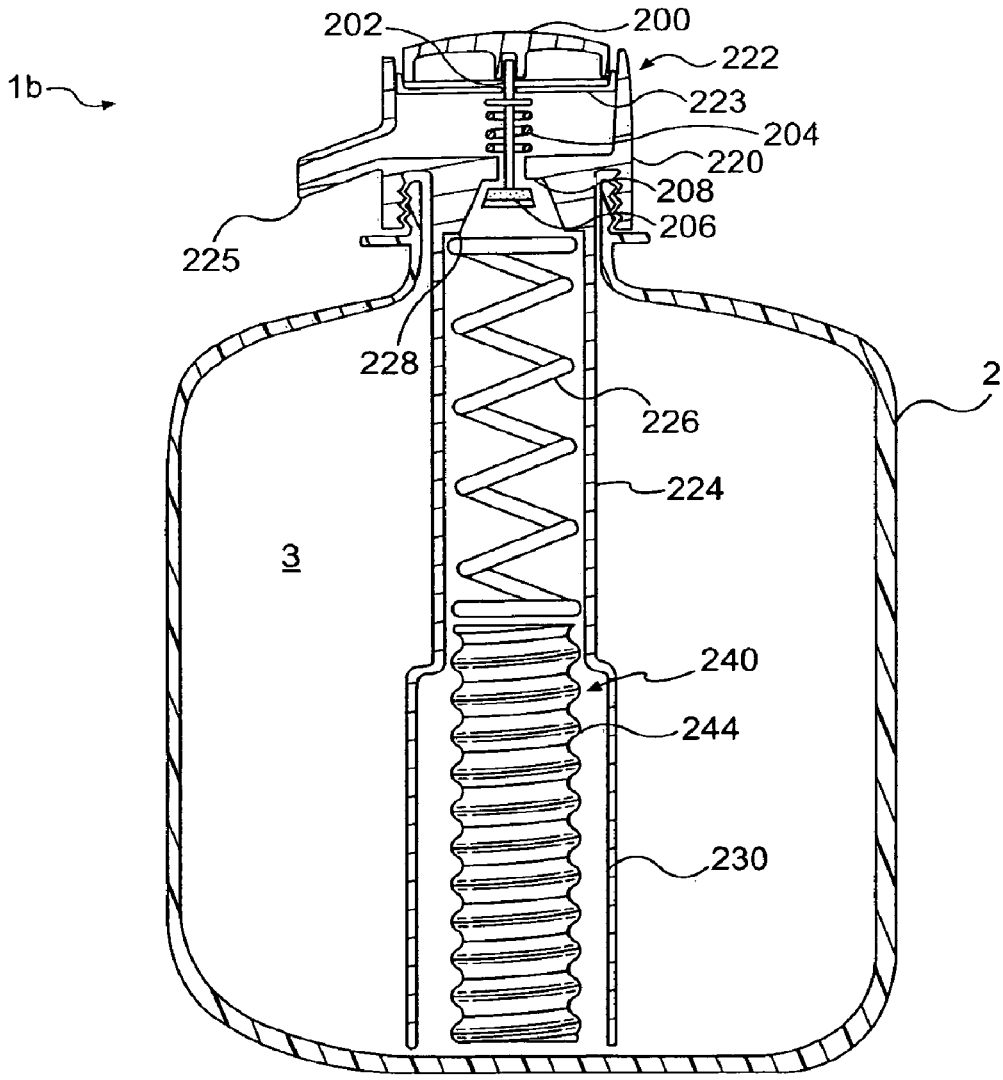
FIG. 7 is a cross-sectional view of a dispensing mechanism according to a second embodiment of the present invention.

As shown in FIG. 7, the dispensing mechanism 1*b* of the second embodiment generally comprises a housing 220, a main spring 226, and a vertically-movable column 240. The housing 220 includes a head selection 222 that houses a valve assembly, a middle section 224 that houses the main spring 226 and a tail section 230 that houses the column 240. The head section 222 includes a nozzle 225 and is preferably affixed to the container 2 using threads, but other means for affixing the container 2 and the head section 222 are contemplated as already discussed with respect to the first embodiment. The head section 222 also includes a shoulder 228 against which the main spring 226 abuts.

As shown in FIG. 7, the tail section 230 preferably has a larger inner diameter than that of the middle section 224. Preferably, the tail section 230 includes apertures or slots to permit fluid communication from outside the housing 220 (i.e., from the interior 3 of the container 2) to the inside of the housing 220. Alternatively, the length of the tail section 230 is such that a space is provided between the bottom of the tail section 230 of the housing 220 and the bottom of the container 2, so that fluid communication is possible through the space. The tail section 230 also preferably includes means for securing the column 240 in the housing 220 even when the housing 220 is not attached to the container 2. Such means include a plurality of protrusions which extend radially inward or a cross bar. Alternatively, the column can be secured to main spring 226, which in turn is secured to shoulder 228.

The valve assembly comprises an actuator 200, a linkage 202, which extends through a top cap 223 and is biased upward by a spring 204, and a plunger 206. According to this arrangement, the plunger 206 normally rests against a seat 208 (i.e., the plunger is "normally closed"). When the actuator 200 is pressed downward, the plunger 206 becomes unseated.

Figure 8:
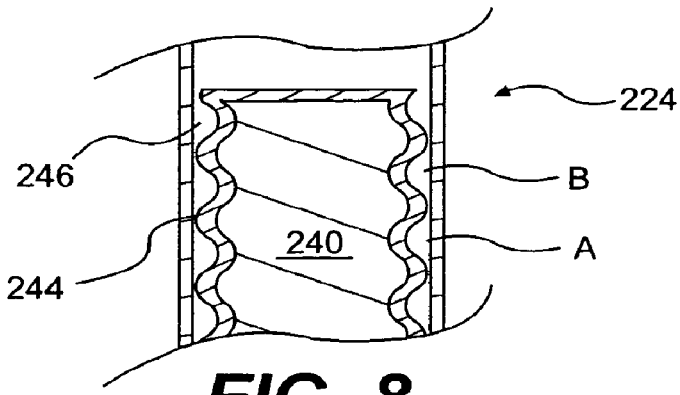
FIG. 8 is a partial cross-sectional view of a column disposed within a housing according to the second embodiment.

The column 240 is preferably circular in cross-section, as is the middle section 224, but other cross-sectional shapes may be used for both of the column 240 and the middle section 224. As shown in FIG. 8, the column 240 may be hollow with a closed top, but both the top and bottom may be closed. The column 240 comprises a continuous, helical ridge 244 on the outer circumference of the column 240. The helical ridge 244 defines a continuous, helical groove. By helical, an ascending, peripheral form is meant, regardless of the cross-sectional shape of the column 240. The helical ridge 244 of the column 240 may be coated or covered by rubber or another soft material to seal against the inner wall of middle section 224.

With reference to FIG. 8, the helical ridge 244 is preferably dimensioned so that if the column 240 is fully within the middle section 224, a flow path 246 is created that is defined by the helical ridge 244 and the inner wall of the middle section 224, whereby gas or liquid does not bypass, for example, across the helical ridge 244, directly from point A to point B. Rather, the beverage flows through the helical groove or flow path 246.

The length of the flow path 246 is controlled by the position of the column 240. When the column 240 is fully within the middle section 224 of the housing 220, the flow path 246 is at its longest possible length. When a portion of the column 240 is outside of the middle section 224, the beverage can flow past that portion of the column 240 and is not constrained within that portion of the flow path 246. Accordingly, in this configuration, the flow path 246 is shorter than when the column 240 is fully within the middle section 224.

The number of turns in the helical ridge 244, and the length of the column 240, is determined based on the desired pressure drop across the dispensing mechanism 1*b*. As is well known, for tubes of a given diameter, the longer the tube, the greater the pressure drop across it. In this case, if the helical ridge 244 is designed with more turns, or if the column 240 is designed to be longer, the flow path 246 gets longer, thereby increasing the pressure drop.

The head section 222, the middle section 224 and the tail section 230 are all preferably integrally formed to constitute the housing 220. Of course, one of ordinary skill will appreciate that the housing 220 may comprise two or more separate pieces, as ease of manufacturing or other factors may require.

In a preferred method of operation for use with carbonated beverages, the actuator 200 is initially in the close position. In this position the, the pressure within the container 2 is greater than the pressure in the surrounding atmosphere, because some of the gas within the beverage escapes into the head: space above the liquid and pressurizes the container 2. However, the pressure acting on the top and the bottom of the column 240 is equalized. As a result, the main spring 226 is the only force acting on the column 240, which therefore moves downward until the spring 226 is fully extended or the column 240 touches the bottom of the container 2.

When a user depresses the actuator 200, the pressure acting on the top of the column 240 approaches atmospheric pressure, which is generally less than the pressure within the container 2, especially when the container 2 is full of a carbonated beverage. This pressure differential across the column 240 and the frictional force caused by the flow of soda in the flow path 246 cause the column 240 to be biased upward against the downward bias of the spring 226. Accordingly, the column 240 moves upward and the spring 226 is compressed until an equilibrium is attained. Due to pressure differential across column 240, penetration of column 240 into middle section 224 will be maximum when the pressure within the container is greatest (i.e., when the container is fresh and/or full of beverage) and minimum when the container pressure is lowest (i.e., when the container volume is low and/or the carbonation level is low). As discussed previously, as the column 240 ascends into the middle section 224, the flow path 246 increases in length. In this way, the pressure drop, which is a function of the length of the flow path 246, is adjusted automatically depending on the pressure within the bottle 2.

When the user releases the actuator 200, the plunger 206 returns to the closed position and the beverage stops flowing out of the nozzle 225. The pressure acting on the top of the column 240 then equalizes with the pressure acting on the bottom of the column 240 as beverage and gas flow into the area between the top of the column 240 and the plunger 206. Accordingly, the spring 226 is again the only force acting on the column 240, so the column 240 is moved downward.

The spring 226 preferably has a predetermined spring constant for biasing the column 240 such that the column 240 is fully within middle section 224 of the housing 220 when pressure within the container 2 is greatest, such as when the container 2 is full of a carbonated beverage. In addition, the column 240 is preferably descended (i.e., at least partially outside of the middle section 224) when the pressure within the container 2 is lower. Of course, the spring constant may be adjusted, in order to optimize the flow characteristics of the beverage so that the column 240 may be disposed at different positions within the housing 220 than those specifically mentioned.

Third Embodiment

The third embodiment also works on the principle of providing a variable pressure drop across the dispensing mechanism as in the first and second embodiments. In the third embodiment, variable pressure drop is automatically achieved by squeezing a plurality of tubes by an amount that depends on the pressure in the container 2.

Figure 9:
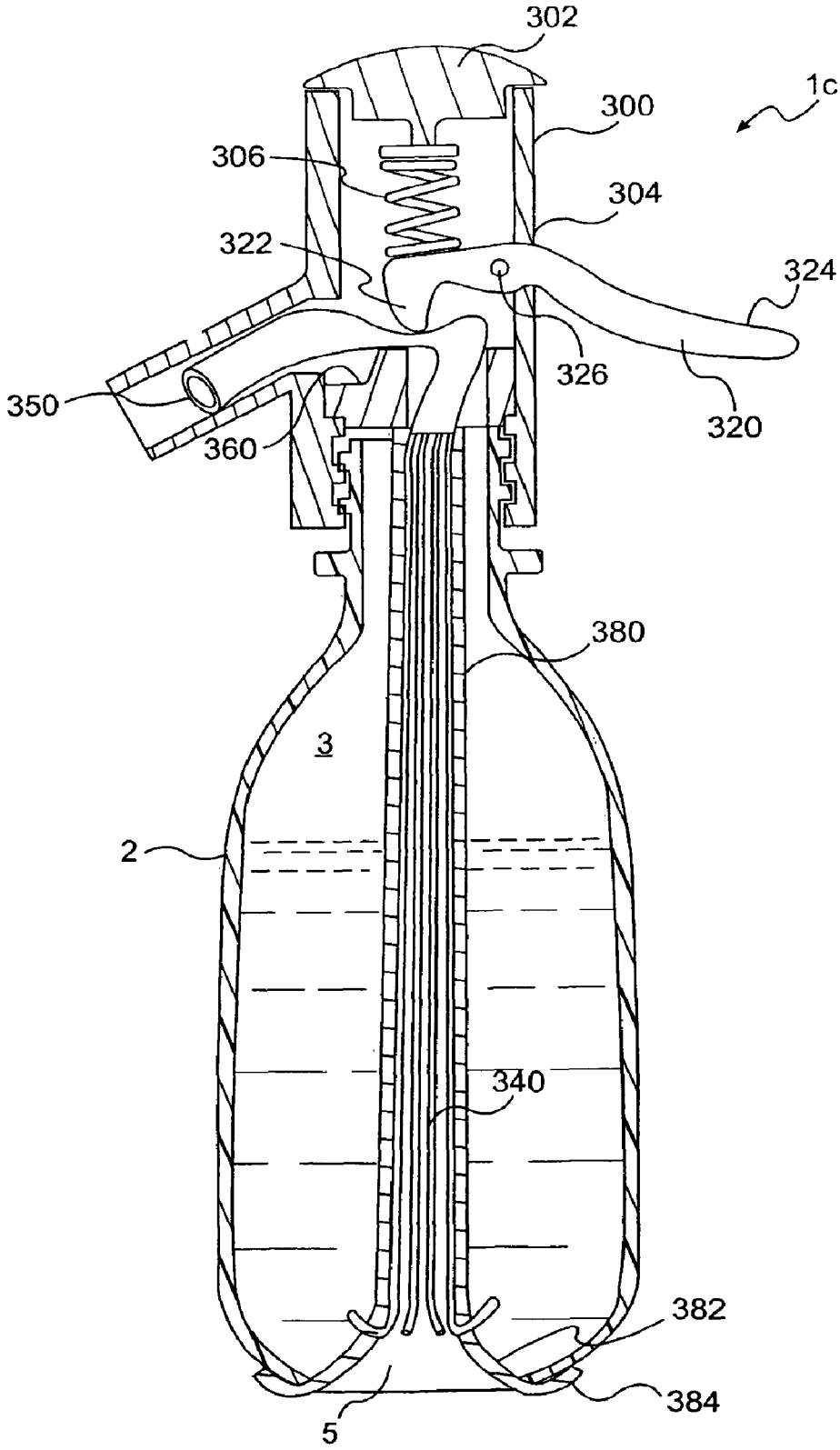
FIG. 9 is a cross-sectional view of a dispensing mechanism according to a third embodiment of the present invention.

As shown in FIG. 9, the dispensing mechanism 1*c* of the third embodiment generally comprises a valve assembly and a flexible membrane 380 housing a plurality of tubes 340. Although a plurality of tubes 340 is shown in FIG. 9, a single tube 340 may be used.

The valve assembly comprises a housing 300, an actuator 320, a block 360 and a spring 306. The housing 300 comprises an end cap 302, which may be welded, glued, threaded or otherwise joined to a main body 304 of the housing 300. The spring 306 biases the actuator 320 against at least one main tube 350 (which is not shown in cross-section in FIG. 9), so that a nub 322 on the actuator 320 presses the main tube 350 against the block 360, closing off the main tube 350 against the passage of gas or liquid. The actuator 320 is hingedly connected to the main body 304 of the housing 320 so that a user can press on an end 324 of the actuator 320 to pivot the actuator 320 about a hinge 326, release the main tube 350 from the pressure of the nub 322, and open the main tube 350 to permit fluid flow.

The elongated, flexible membrane 380 surrounds all of the tubes 340 and extends from an aperture 5 in the bottom of the container 2 to the block 360, although the membrane 380 may be longer or shorter. The membrane 380 is sealingly attached around the aperture in the container 2 so that fluid and gas will not escape from the junction of the membrane 380 and the container 2. The membrane 380 may be glued, welded or otherwise joined to the container 2. By this arrangement, shown in detail in FIG. 10, the exterior 382 of the membrane 380 is subjected to the pressure within the bottle 2, while the interior 384 of the membrane 380 is open to the atmosphere through the aperture 5 and therefore is subjected to atmospheric pressure.

Figure 10:
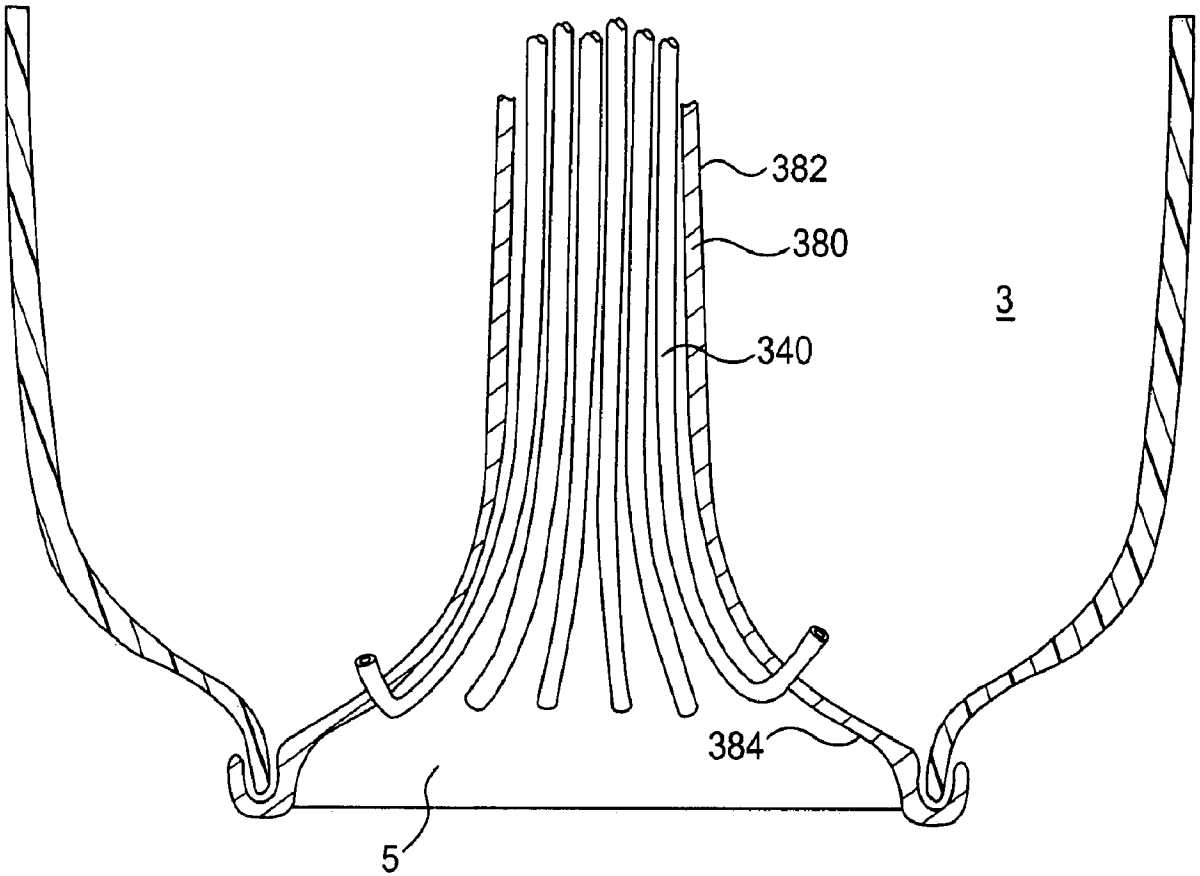
FIG. 10 is a partial cross-sectional view of the dispensing mechanism according to the third embodiment.

Each tube 340 protrudes through the membrane 380 into the space 3 within the bottle 2, as shown in FIG. 10. The junction where the tubes 340 and the membrane 380 meet is preferably sealed against the passage of gas or liquid by use of a seal, or by way of close tolerances between an aperture in the membrane 380 through which each tube 340 protrudes.

The diameter of each tube 340 and the number of tubes 340 is determined based on such factors as the flexibility or compressibility of the tubes 340, the pressures typically found in the container 2, and the surface roughness of the tube material. Other factors may also be considered, such as cost.

A preferred method of the third embodiment will now be described. When the container 2 contains a carbonated beverage, the pressure inside the bottle 2 is greater than the atmospheric pressure outside the bottle 2. Therefore, the pressure on the exterior 382 of the membrane 380 is greater than the pressure on the interior 384 of the membrane 380 because the interior 384 is exposed to the atmosphere. This pressure differential deforms the membrane 380 so that it compresses the tubes 340, effectively decreasing the cross-section of each of the tubes 340 and restricting fluid flow through the tubes 340. The extent that the tubes 340 are compressed is proportional (or at least related) to the pressure inside the container 2. Therefore, when the pressure inside the container 2 is greatest, the tubes 340 are compressed to the greatest extent and the greatest degree of restriction is achieved.

As the beverage in the container 2 is consumed, the pressure within the container 2 decreases. Therefore, the pressure differential between the exterior 382 and the interior 384 of the membrane 380 also decreases and the compression force on the tubes 340 decreases. In response, the cross-section of each of the tubes 340 increases, thereby decreasing the restriction of the fluid flow through the tubes 340.

Because the tubes 340 are compressed in proportion to the pressure differential and the pressure drop across the dispensing mechanism Id increases as the tubes 340 are compressed, the dispensing mechanism Id is capable of automatically regulating the pressure drop so that the flow out the main tube 350 is effectively controlled generally less when pressure within the container 2 is less, such as when some of the beverage has been dispensed over time and such dispensing has resulted in erosion of the tube.

Fourth Embodiment

The fourth embodiment also works on the principle of providing a variable pressure drop across the dispensing mechanism 1*d* as in the first through third embodiments. In the fourth embodiment, variable pressure drop is achieved by providing an eroding tube that varies its cross-sectional area over time.

Figure 11:
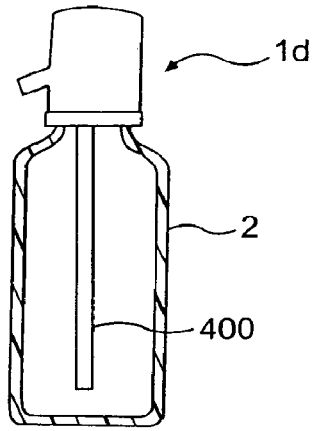
FIG. 11 is a side view of a dispensing mechanism and a bottle according to a fourth embodiment of the present invention.

FIG. 11 shows an eroding or dissolvable tube or pipe 400 disposed inside the container 2 for withdrawing fluid from the container 2. The tube 400 may be connected to any number of valve assemblies for selectively dispensing fluid, such as the plunger-valve system of the second embodiment, or the actuator-valve of the third embodiment. In addition, the valve assemblies may be attached to the container 2 by any means as described previously.

The dissolvable tube 400 is composed of a material that dissolves over time when in contact with the beverage. The material of the dissolvable tube 400 may be any number of non-toxic substances, but is preferably a sugar- or artificial sweetener-based material. The dissolvable tube 400 may have a non-soluble coating on an exterior 404 thereof, so that the interior of the tube will dissolve, but not the exterior.

As previously discussed with respect to the previous embodiments, as the diameter of the tube 400 increases, the pressure drop across the dispensing mechanism 1*d* decreases. Therefore, in the fourth embodiment, the pressure drop across the dispensing mechanism 1*d* is generally greatest when the container 2 is fresh and the pressure within the container 2 is greatest, such as when the container 2 is full of the beverage. Moreover, the pressure drop is generally less when the pressure within the container 2 is less, such as when some of the beverage has been dispensed over time and such dispensing has resulted in erosion of the tube.

Figure 12:
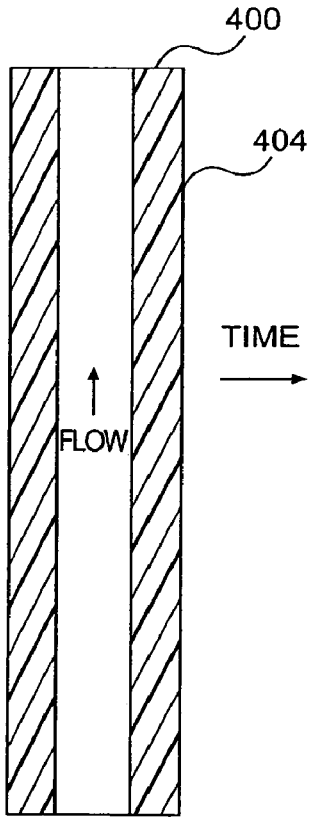
FIGS. 12 through 14 are cross-sectional views of an eroding tube according to the fourth embodiment.
Figure 13:
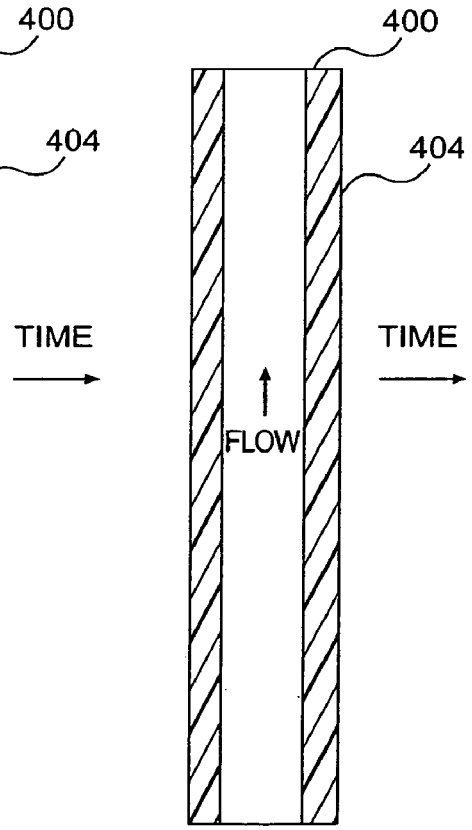
Figure 14:
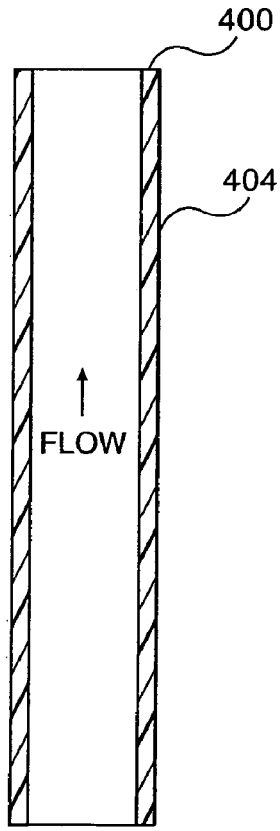

The condition of the dissolvable tube 400 over time is shown in FIGS. 12 through 14. As shown in the Figures, the dissolvable tube 400 is eroded from the interior so that the inner diameter of the tube 400 increases over time. The tube 400 is preferably composed of a material that erodes at a rate roughly proportional to the decrease in pressure inside the bottle 2, such as occurs, for example, when the beverage is dispensed. Therefore, throughout the dispensing of the bottle, the flow rate of dispensed liquid will be substantially the same.

Fifth Embodiment

The fifth embodiment works on the principle of providing a variable pressure drop across the dispensing mechanism as in the first through fourth embodiments. In the fifth embodiment, a user may select the pressure drop across the dispensing mechanism 1*e* by selecting how far an actuator is depressed.

Figure 15:
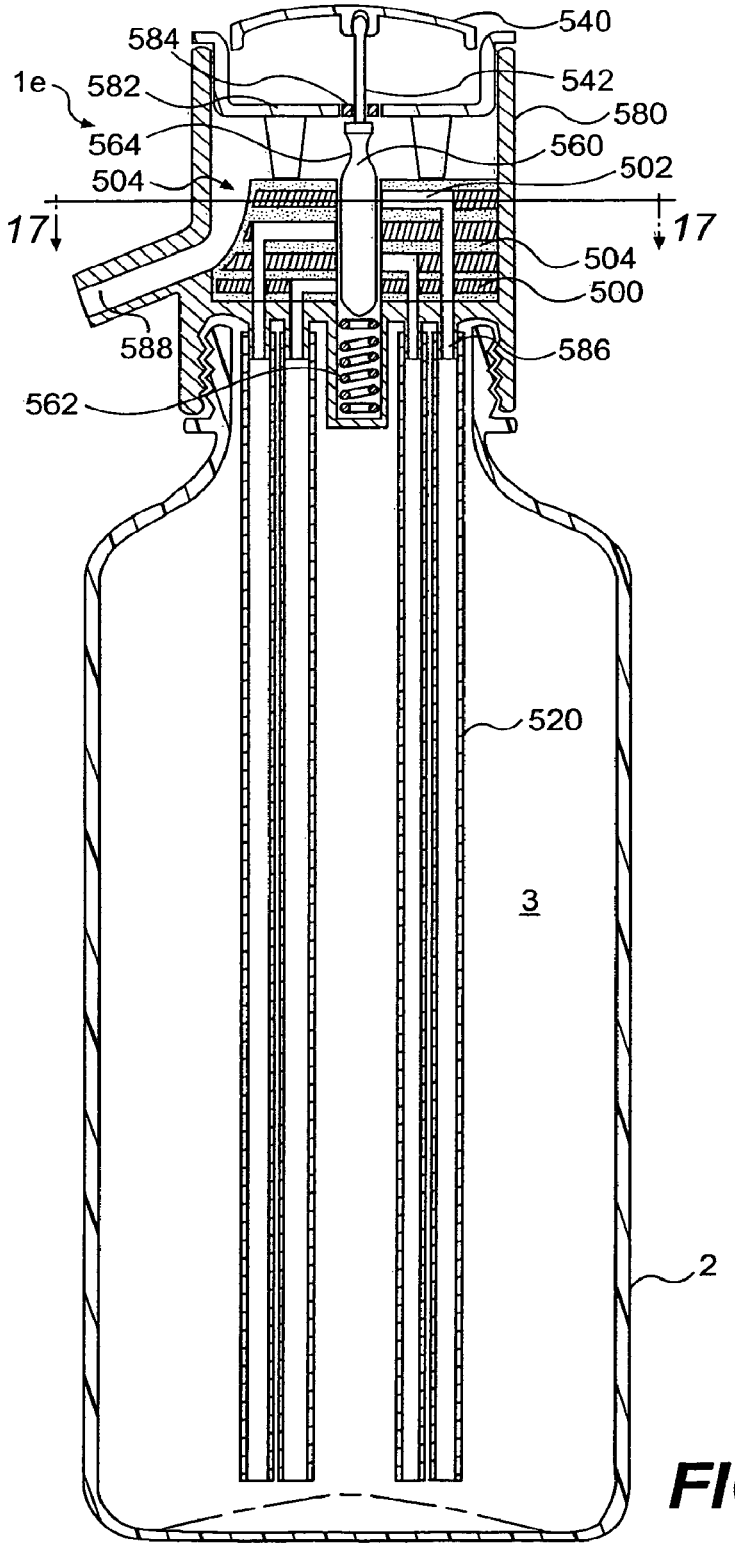
FIG. 15 is a cross-sectional view of a dispensing mechanism according to a fifth embodiment of the present invention.

FIG. 15 shows the dispensing mechanism 1*e*, which generally comprises a valve assembly, a regulator block 500 and a plurality of tubes 520. The valve assembly comprises a housing 580 having a nozzle 588, an actuator 540 connected to an actuator rod 542, a barrel valve 560 on the opposite end of the actuator rod 542 from the actuator 540, the barrel valve 560 biased upward by a spring 562, and a cap 582. The barrel valve 560 has a generally cylindrical shape with a contoured portion 564 at a top thereof. A seal 584 is preferably provided at the junction between the actuator rod 542 and the cap 582, so that gas and liquid cannot escape past the seal 584. The cap 582 may be attached to the housing 582 in any number of ways, such as gluing, welding, threads, rivets, etc. The housing 582 is attached to the container 2 by threads, but other means for attaching the container 2 and the housing 582 are contemplated, as previously mentioned in the first through fourth embodiments.

Figure 16:
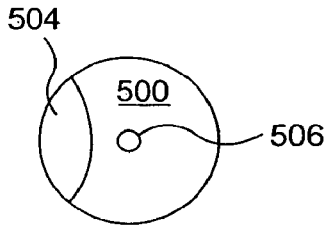
FIG. 16 is a top view of a regulator block according to the fifth embodiment.
Figure 17:
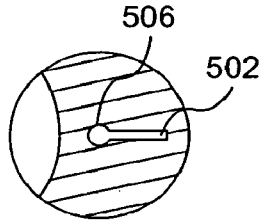
FIG. 17 is a cross-sectional view of the regulator block taken along the line 17-17 in FIG. 15, according to the fifth embodiment.

The regulator block 500 is disposed within the housing 580, and is preferably affixed to the interior of the housing 580. As shown in FIGS. 15 and 16, the regulator block 500 includes a sloped portion 504 and an aperture 506, which extends through the thickness of the regulator block 500 and is adapted to receive the barrel valve 560. In addition, the regulator block 500 comprises a plurality of flow chambers 502, preferably four flow chambers 502. As best seen with reference to FIGS. 15 and 17, the flow chambers 502 are provided in the regulator block 500 such that a fluid path is created from the bottom of the regulator block 500 to the aperture 506.

The barrel valve 560 is disposed within the aperture 506 and biased upward by the spring 562 so that the barrel valve 560 is normally in a closed position. In other words, the barrel valve 560 normally closes the aperture 506 so that gas or liquid cannot pass through the aperture 506.

Figure 18:
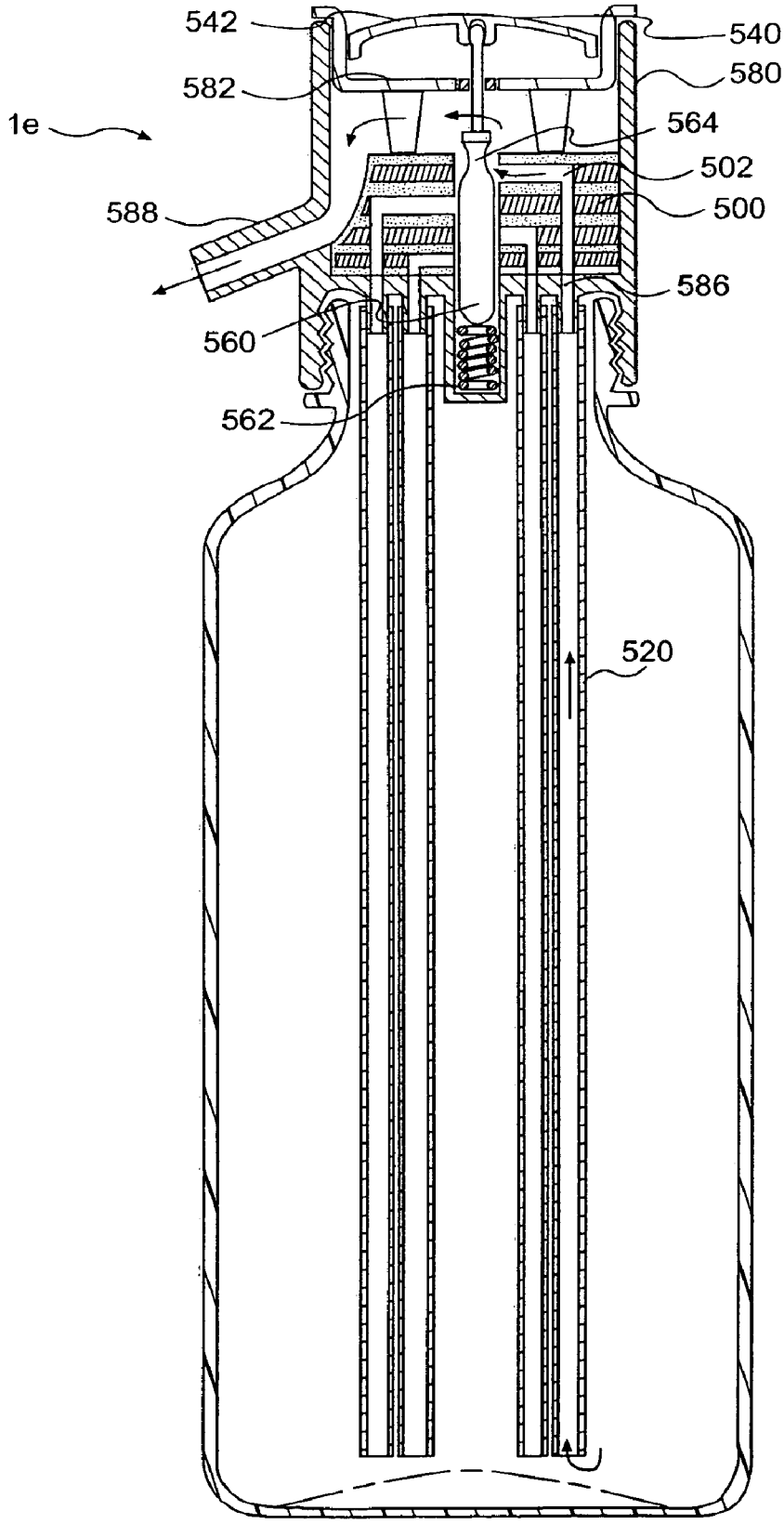
FIG. 18 is a cross-sectional view of the dispensing mechanism according to the fifth embodiment, in which the dispensing mechanism is configured to dispense fluid.

As shown in FIG. 18, when the actuator 540 is depressed by a user, the barrel valve 560 descends so that a contoured portion 564 of the barrel valve 560 is aligned with one of the flow chambers 502. When the barrel valve 560 is in this position, fluid and gas can flow along the path shown with arrows in FIG. 18, that is, into the aperture 506 and through the top of the regulator block 500, into the interior of the housing 580, and finally out of the nozzle 588. In FIG. 18, the barrel valve 560 is depressed far enough that one flow chamber 502 is opened. The barrel valve 560 can also be depressed far enough to open two or more flow chambers 502.

The flow chambers 502 are aligned with apertures 586 in the bottom of the housing 582, each of which is in turn aligned with one of the plurality of tubes 520. By this arrangement, a flow conduit is created when the barrel valve 560 is depressed. The flow conduit extends from the bottom of the tube 520, through the tube 520 and the aperture 586, through the aperture 502 and out of the nozzle 588, as shown in FIG. 18.

As shown in FIGS. 15 and 18, the tubes 520 are connected to the regulator block in parallel. In this way, as more tubes 520 are opened, the beverage within the container 2 has a greater area through which it can flow. Therefore, as more tubes 520 are opened, the pressure drop across the dispensing mechanism 1*e* decreases. As with the first embodiment, the tubes can be of identical design or different in cross-section, length or material to vary their resistances.

In a preferred method of operation, a user depresses the actuator 540, which depresses the barrel valve 560. As the actuator 540 is depressed, the barrel valve 560 at first opens only one flow chamber 502, but increasing numbers of flow chambers 502 may be opened by depressing the actuator 540 further. Therefore, when the pressure within the container 2 is relatively high, such as when the container 2 is full, a user may depress the actuator 540 only slightly to open a single tube 520. As the pressure within the bottle 2 decreases, the user may depress the actuator 540 further to open more tubes 520. In this way, a user can adjust the pressure drop, and therefore the flow resistance, across the dispensing mechanism 1*e* so that a controlled, smooth flow is always achieved regardless of the pressure within the container 2.

Sixth Embodiment

In a preferred method of operation, a user depresses the actuator 540, which depresses the barrel valve 560. As the actuator 540 is depressed, the barrel valve 560 at first opens only one flow chamber 502, but increasing numbers of flow chambers 502 may be opened by depressing the actuator 540 further. Therefore, when the pressure within the container 2 is relatively high, such as when the container 2 is full, a user may depress the actuator 540 only slightly to open a single tube 520. As the pressure within the bottle 2 decreases, the user may depress the actuator 540 further to open more tubes 520. In this way, a user can adjust the pressure drop, and therefore the flow resistance, across the dispensing mechanism 1*e* so that a controlled, smooth flow is always achieved regardless of the pressure within the container 2.

Figure 19:
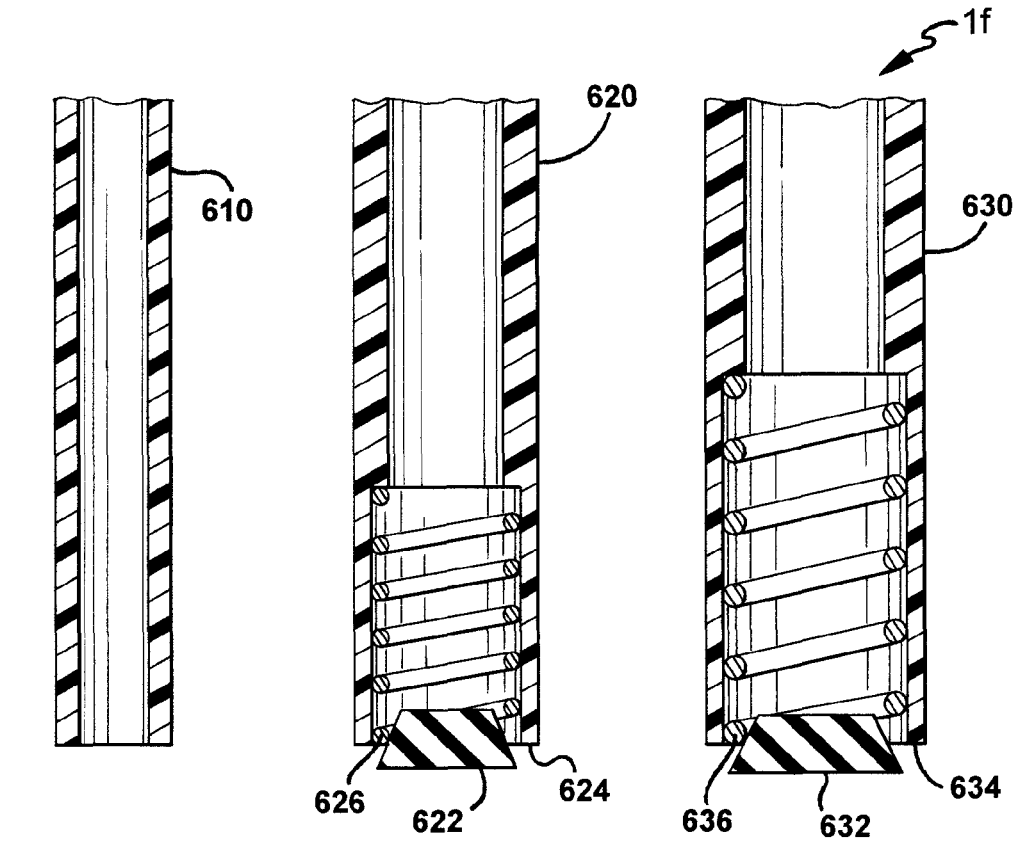
FIG. 19 is a cross-sectional view of an exemplary dispensing mechanism according to a sixth embodiment.

FIG. 19 shows a series of tubes 610, 620, 630 disposed inside a container for withdrawing fluid from the container. As with the fourth embodiment, the tubes may be connected to one of any number of valve assemblies for selectively dispensing fluid, such as the plunger-valve system of the second embodiment, or the actuator-valve system of the third embodiment. The valve assemblies may be attached to the container by any means as described previously.

As shown in FIG. 19, the three tubes are of different cross-sections, with tube 610 being of the smallest cross-section, tube 620 being of intermediate cross-section, and tube 630 being of the greatest cross-section. The dispensing mechanism is designed to allow fluid flow only through tube 610 when the pressure within the container is highest, tube 610 and 620 at intermediate pressures, and all three tubes 610, 620, 630, when the pressure is lowest. This is accomplished by providing pressure sensitive valves 622, 632 at the inlets of the larger tubes, 620, 630, respectively. Although the valves are provided at the openings of the tubes in the preferred embodiment, such valves can be positioned anywhere in the flow paths. Valve 622 is seatable on valve seat 624 of intermediate tube 620, whereas valve 632 is seatable on valve seat 634 of tube 630. The valves are biased normally open by springs 626, 636 in the respective tubes. The spring constant of spring 626 is designed to be greater than that of spring 636, such that valve 622 will open at a greater threshold pressure than that of valve 632. Both valves are designed to be closed by pressure within the container when that pressure is highest.

In use, when the dispensing valve (not shown) is open and the pressure within the container is highest (i.e., when the container is fresh and nearly full), valves 622 and 632 are seated on their respective valve seats and fluid only flows through tube 610. As more fluid is dispensed, the pressure within the container decreases below a first threshold pressure at which valve 622 opens, presenting an increased area for fluid flow through tubes 610 and 620. As the pressure decreases below a second threshold pressure, valve 632 also opens so that fluid can flow through all three tubes 610, 620 and 630. Therefore, when the pressure is highest, the pressure drop is greatest to provide a smooth transition from the high-pressure environment of the container to the low-pressure ambient environment to reduce the exit velocity to a manageable level. As the pressure within the container decreases, more flow passages are opened to maintain the flow rate substantially constant throughout dispensing.

In this embodiment, three tubes of varying diameters were described, with two of the tubes being valved. However, the variation in resistance of the tubes need not be due to different diameters, but could also be due to different lengths or different materials forming the tubes. Further, the plural tubes can be of the same resistance and as more tubes are opened, the cumulative resistance decreases. The number of tubes is not limited to three and the number of valves is also not limited.

The dispenser may also include additional flow regulating or restricting components, such as a porous flow control-type flow regulator as described in detail in U.S. patent application Ser. No. 11/081,280, filed Mar. 16, 2005 and entitled "Dispenser Assembly Having a Porous Flow Control Member," which is incorporated herein by reference. Another dispenser includes a conical valve assembly as described in greater detail in U.S. Pat. No. 7,584,874, issued Sep. 8, 2009, and entitled "Dispenser Having a Conical Valve Assembly," which is also incorporated herein by reference.

The components of each of the foregoing embodiments may be composed of a variety of materials, including polyethylene terephthalate, polypropylene, and polyvinylchloride. In addition to these materials, the tubes may be composed of rubber. Of course, other materials in addition to those specifically mentioned may be used.

While the present invention has been described with respect to what is currently considered to be the preferred embodiments, the present invention is not limited to the disclosed embodiments. Rather, the present invention covers various modifications and equivalent arrangements included within the spirit and scope of the appended claims. The scope of the appended claims is to be accorded the broadest interpretation so as to encompass all such modifications and equivalent structures and functions.

We claim:

1. An assembly comprising:

a housing adapted to attach to a container adapted to contain a pressurized fluid, the housing having a nozzle and a fluid outlet adapted to dispense pressurized contents;

an actuator for selectively opening the fluid outlet of said housing; said actuator connected to said housing; and a plurality of tubes communicating with the fluid outlet operatively connected to the nozzle and extending into the container and a barrel valve, wherein the barrel valve is configured to selectively open one or more of the plurality of tubes to permit fluid flow through the fluid outlet, and wherein the plurality of tubes and the barrel valve are provided to vary the fluid flow.

2. The assembly of claim 1 wherein the barrel valve is biased closed by a spring.

3. The assembly of claim 1 wherein the fluid flow is permitted to flow through a first tube in a first position.

4. The assembly of claim 3 wherein the fluid flow is permitted to flow through the first tube and a second tube in a second position.

5. The assembly of claim 4 wherein the fluid flow is permitted to flow through the first tube, the second tube and a third tube in a third position.

6. The assembly of claim 5 wherein the fluid flow is permitted to flow through the first tube, the second tube, the third tube, and a fourth tube in a fourth position.

7. The assembly of claim 1 wherein the rate of fluid flow is varied manually by the user.

8. The assembly of claim 1 wherein the plurality of tubes have different resistances to fluid flow.

9. An assembly comprising:

a housing adapted to attach to a container adapted to contain a pressurized fluid, the housing having a nozzle and a fluid outlet adapted to dispense pressurized contents;

an actuator for selectively opening the fluid outlet of said housing; said actuator connected to said housing; and means for varying a resistance of the fluid such that the fluid is dispensed from the container at a substantially constant flow rate, wherein the means for varying the resistance has a plurality of tubes having different resistances to fluid flow, and wherein the resistance is varied manually by the user.

10. The assembly according to claim 9 wherein the means for varying the resistance of the fluid comprises a barrel valve.

11. The assembly of claim 10 wherein the barrel valve is biased closed by a spring.

12. The assembly of claim 10 wherein the actuator is configured to open the barrel valve to open one or more of the plurality of tubes.

13. The assembly of claim 9 wherein the rate of fluid flow is varied manually by the user.

14. A method for dispensing fluid at a substantially constant flow rate comprising:

providing a pressurized fluid in a container, the container having a nozzle and a fluid outlet adapted to dispense pressurized contents;

providing an actuator for selectively opening the fluid outlet of the container;

providing a plurality of tubes communicating with the fluid outlet operatively connected to the nozzle and extending into the container and a barrel valve; and manipulating the actuator so as to cause the barrel valve to selectively open one or more of the plurality of tubes to permit fluid flow through the fluid outlet and to vary the fluid flow through the nozzle.

15. The method of claim 14 further comprising biasing the barrel valve closed by a spring.

16. The method of claim 14 further comprising depressing the actuator to cause the barrel valve to move to a first position to open one of the plurality of tubes.

17. The method of claim 16 further comprising depressing the actuator to cause the barrel valve to move past the first position to open more of the plurality of tubes.

18. The method of claim 14 further comprising varying the fluid flow manually by the user.

19. The method of claim 14 further comprising providing different tube resistances to fluid flow.

* * * * *